US006432513B1

(12) United States Patent
Thomsen et al.

(10) Patent No.: US 6,432,513 B1
(45) Date of Patent: Aug. 13, 2002

(54) PROTECTOR PAD

(76) Inventors: Peter Neils Thomsen, 21 Wybalena Road, Hunters Hill, New South Wales 2110; Patrick Joseph Byrne, 8 Thomas Road, Galston, New South Wales 2159, both of (AU)

( * ) Notice: Subject to any disclaimer, the term of this patent is extended or adjusted under 35 U.S.C. 154(b) by 0 days.

(21) Appl. No.: 09/446,666

(22) PCT Filed: Jun. 26, 1998

(86) PCT No.: PCT/AU98/00494

§ 371 (c)(1),
(2), (4) Date: Mar. 14, 2000

(87) PCT Pub. No.: WO99/00161

PCT Pub. Date: Jan. 7, 1999

(30) Foreign Application Priority Data

Jun. 27, 1997 (AU) ..... PO 7603

(51) Int. Cl.[7] ..... B32B 3/00; B32B 3/28; A41D 13/08

(52) U.S. Cl. ..... 428/167; 428/166; 428/172; 428/178; 2/16; 2/22

(58) Field of Search ..... 428/167, 178, 428/172, 166; 2/16, 22, 468, 455

(56) References Cited

U.S. PATENT DOCUMENTS

| | | | | |
|---|---|---|---|---|
| 1,428,731 A | | 9/1922 | Whitley | |
| 4,185,327 A | | 1/1980 | Markve | 2/2 |
| 4,602,385 A | | 7/1986 | Warren | 2/2 |
| 5,034,998 A | * | 7/1991 | Kolsky | 2/2 |
| 5,274,846 A | * | 1/1994 | Kolsky | 2/2 |
| 5,307,521 A | * | 5/1994 | Davis | 2/22 |
| 5,384,913 A | | 1/1995 | Hendry | 2/2 |

FOREIGN PATENT DOCUMENTS

| | | |
|---|---|---|
| DE | 809396 | 7/1951 |
| DE | 1952413 | 4/1971 |
| DE | 3220887 | 12/1983 |
| GB | 228701 | 2/1925 |
| GB | 664623 | 1/1952 |
| GB | 686188 | 1/1953 |

* cited by examiner

*Primary Examiner*—Donald J. Loney
(74) *Attorney, Agent, or Firm*—Abelman, Frayne & Schwab

(57) ABSTRACT

A protector pad (10) for a sportsman includes and outer protector (11) adapted to at least partially assume the shape of the area to be protected and an inner shock absorbing pad (12) in the form of an air cushioned pad. The outer protector (11) is formed from moulded plastics material and has longitudinal ribs (13) which permit the protector to achieve a curvature fit around the area to be protected.

12 Claims, 3 Drawing Sheets

PROTECTOR PAD

FIELD OF INVENTION

This invention relates to protector pads and more particularly to protector pads that are used by sportsmen.

BACKGROUND ART

For the sake of convenience, the invention will be described in relation to a leg protector for footballers but it is to be understood that the invention is not limited thereto as the protector pad may be used in other sports such as baseball and cricket and for protecting other parts of the body.

Hitherto, leg protector pads have been heavy, uncomfortable due to the rigid construction and have not readily absorbed shock. It is, therefore, an object of the invention to provide a protector pad which is flexible and which incorporates a shock absorbing medium.

SUMMARY OF INVENTION

According to one aspect of the invention there is provided a protector pad comprising an outer protector adapted to at least partially assume the shape of the area to be protected and an inner shock absorbing pad.

Preferably the outer protector is longitudinally profiled so that it may be curved laterally around the area to be protected. In one form of the invention, the outer is formed from moulded plastics material and has longitudinal ribs which permit the protector to achieve a full curvature fit around the area to be protected.

The inner shock absorbing pad may be in the form of an air cushioned pad. The air cushioned pad may consist of an inner and outer web separated by a plurality of substantially half-spherical air pockets.

MODES FOR CARRYING OUT THE INVENTION

Figure 1:
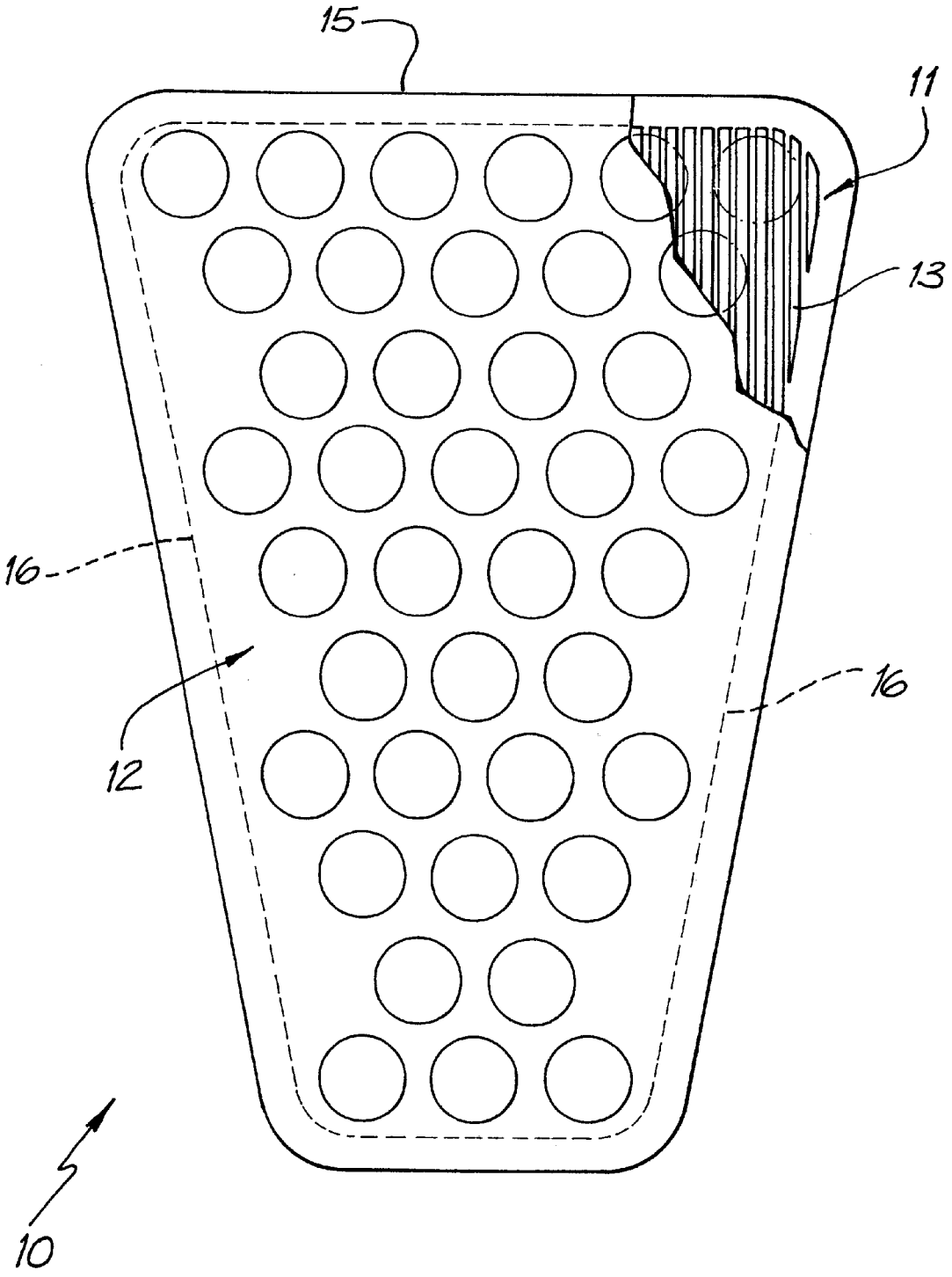
FIG. 1 is a rear view of a protector pad according to one embodiment of the invention.
Figure 2:
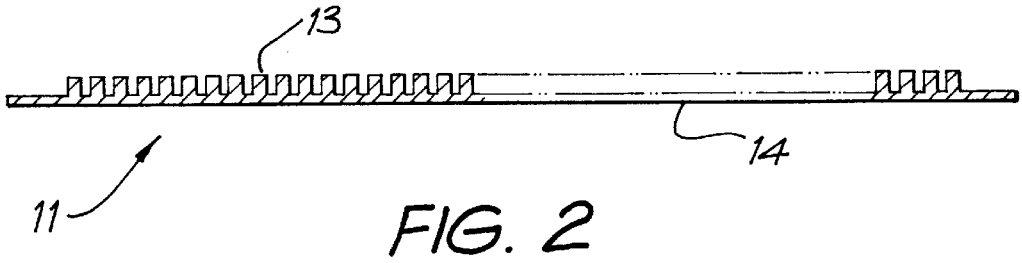
FIG. 2 is a cross-sectional view of the outer of the protector pad shown in FIG. 1.
Figure 3:
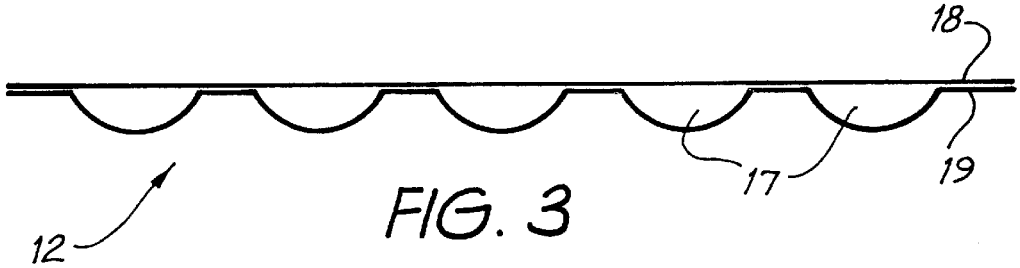
FIG. 3 is a cross-sectional view of the inner shock absorbing pad of the protector pad shown in FIG. 1.
Figure 4:
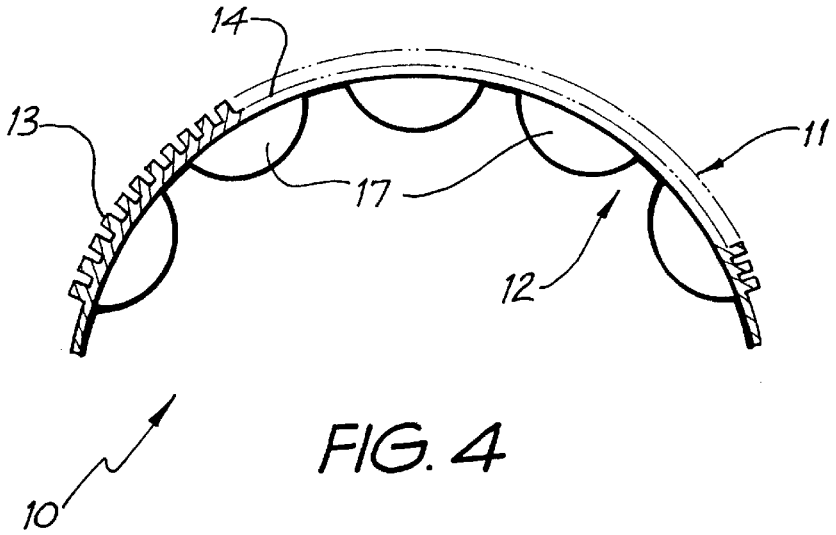
FIG. 4 is a cross-sectional view of the protector pad shown in FIG. 1 in its curved configuration.
Figure 5:
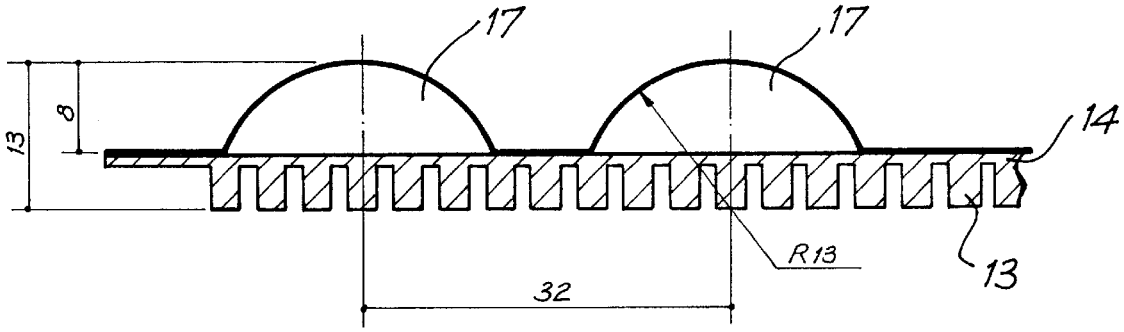
FIG. 5 is a cross-section view of the protector pad of FIG. 1 in its underformed configuration showing preferred dimensions.

The protector pad 10 shown in FIG. 1 includes an outer protector 11 and an inner shock absorbing pad 12. As can be seen in FIGS. 2, 4 and 5, the outer protector 11 has a plurality of elongated ribs 13 projecting outwardly from a base 14. The outer protector 11 may be extruded from any suitable plastics material and as is indicated in FIG. 5 may be 3/16 inch thick. The longitudinal ribs 13 extend from adjacent the top 15 of the outer 11 and terminate at the boundary 15 as shown in FIG. 1.

The inner shock absorbing pad 12 consists of a plurality of substantially semi-spherical air bubbles 17 formed between two sheets 18 and 19. The bubbles 17 may have a radius of ½ inch and height of 5/16 inch and a centre to centre spacing of 1¼ inch as shown in FIG. 5.

Figure 6:
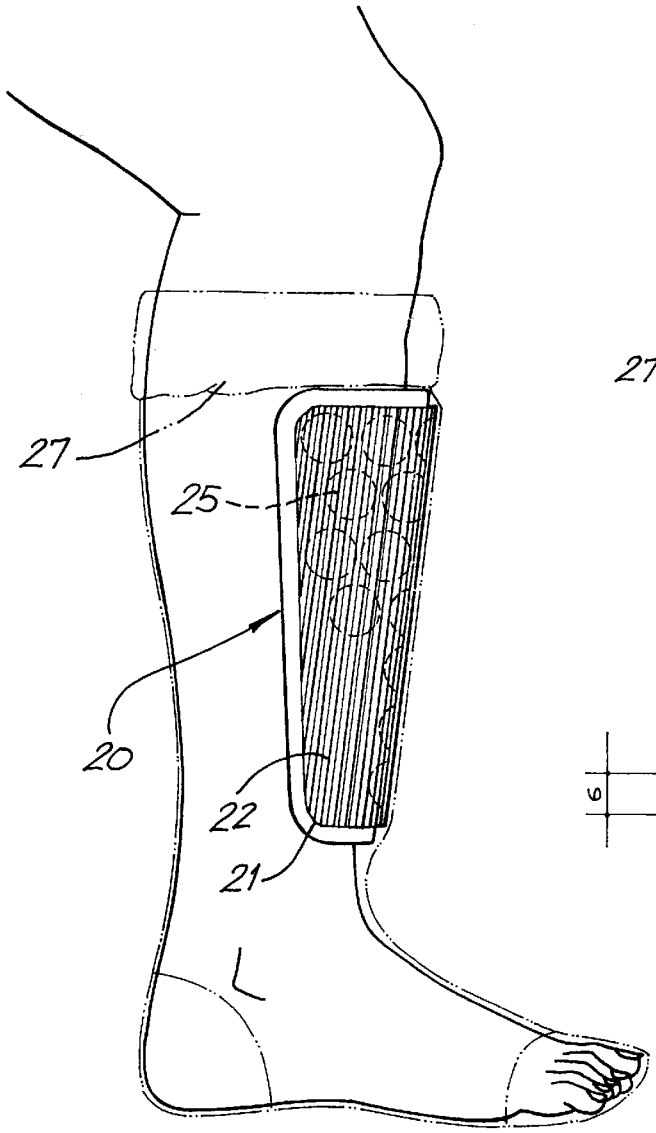
FIG. 6 is a side elevational view of a protective pad according to a second embodiment of the invention positioned within the sock of a wearer.

The protector pad 20 shown in FIG. 6 is somewhat similar to that shown in FIG. 1 except that the outer 21 has opposed longitudinal ribs 22, 23 extending outwardly from opposite faces of the base 24. The inner 25 is similar to that of FIG. 1 in that it consists of substantially semi-spherical air bubbles 26.

Figure 7:
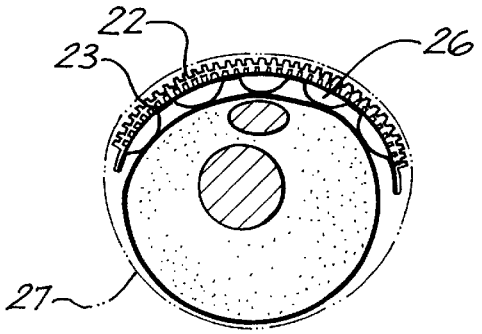
FIG. 7 is a cross-sectional view of the protector pad shown in FIG. 6.
Figure 8:
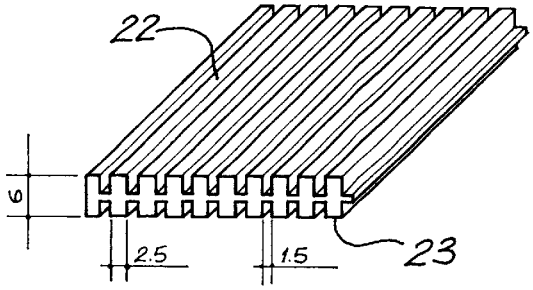
FIG. 8 is a cross-sectional view of the outer of the protector pad shown in FIG. 6.
Figure 9:
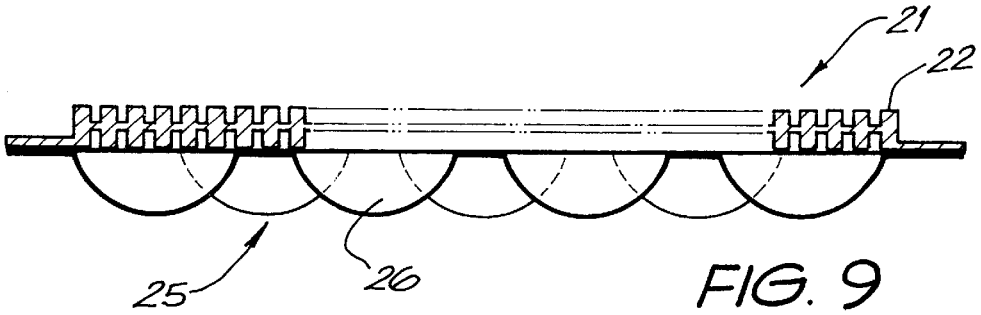
FIG. 9 is a cross-sectional view of the protector pad shown in FIG. 6.

The protector pad 20 is shown in FIG. 6 positioned within a sock 27 and, as can be seen in FIG. 7, the protector pad 20 assumes the curved shape of the footballer's leg. Dimensions of one form of the outer 21 are shown in FIG. 8 where the thickness of the outer is 6 mm, the width of each rib 2.5 mm and the spacing between each rib 1.5 mm.

The invention provides an improved protector pad which may be used in various contact sports such as soccer, rugby, baseball and cricket. The longitudinally profiled outer allows a full curvature fit around the area of the body to be protected and may be constructed from high strength plastics material.

The inner shock absorbing pad may be made from two webs of suitable plastics material with the inner web vacuum-formed to create the substantially half spherical pockets with the outer web being sealed to the inner web to create a number of air filled pockets.

Due to the unique design and combination of selected rigid as well as flexible materials, the protector pad of the invention will not only fit the individual player better and protect the player better than prior art protectors, it will provide improved comfort level and will enable the player to feel less inhibited towards an unforseen direct strike or kick. The participant may therefore move faster and speed up the game.

Various modifications may be made in details of design and construction without department from the scope and ambit of the invention.

What is claimed is:

1. A protector pad for a sportsman comprising a solid outer protector having a base from which extend a plurality of elongated ribs, the outer protector adapted to at least partially assume the shape of the area to be protected and an inner shock absorbing pad, said inner shock absorbing pad consisting of a pair of overlying sheets of flexible material sealed together with a plurality of spaced apart, non-connected, air-filled pockets therebetween.

2. A protector pad according to claim 1 wherein the outer protector is longitudinally profiled so that it may be curved laterally around the area to be protected.

3. A protector pad according to claim 2, wherein the outer protector is formed from molded plastics material and has longitudinal ribs which permit the protector to achieve a curvature fit around the area to be protected.

4. A protector pad according to claim 1 wherein each air pocket is semi-spherical.

5. A protector pad according to claim 4 wherein the semi-spherical pockets are formed in one of the overlying sheets of flexible material.

6. A protector pad according to claim 5 wherein the semi-spherical pockets are substantially of the same shape and the center to center spacing of the semi-spherical pockets is greater than the diameter of each semi-spherical pocket.

7. A protector pad according to claim 6 wherein the semi-spherical pockets are arranged in rows with the center of each semi-spherical pocket in one row being off-set from the centers of the semi-spherical pockets in adjacent rows.

8. A protector pad for a sportsman comprising a solid outer protector having a base from which extend a plurality of elongated ribs, the outer protector adapted to at least partially assume the shape of the area to be protected and an inner shock absorbing pad, said inner shock absorbing pad consisting of a pair of overlying sheets of flexible material sealed together with a plurality of spaced-apart, non-connected, air-filled pockets therebetween, wherein each air pocket is semi-spherical and the semi-spherical pockets are arranged in rows with the center of each of the semi-spherical pockets in one row being off-set from the centers of the semi-spherical pockets in adjacent rows.

9. A protector pad according to claim 8, wherein the outer protector is extruded.

10. A protector pad according to claim 8, wherein the base has two sides and a plurality of elongated ribs extend from each side of the base.

11. A protector pad according to claim 1, wherein the outer protector is extruded.

12. A protector pad according to claim 1 wherein the base has two sides and a plurality of elongated ribs extend from each side of the base.

* * * * *